US006656016B1

(12) United States Patent
Zhu et al.

(10) Patent No.: US 6,656,016 B1
(45) Date of Patent: Dec. 2, 2003

(54) SAND BLASTING APPARATUS AND METHODS

(75) Inventors: Naiping Zhu, Strongsville, OH (US); Stephen D. Cherico, North Olmsted, OH (US); Kenneth R. Taylor, Amsterdam, OH (US)

(73) Assignee: Fosbel Intellectual AG, Pfaffikon (CH)

( * ) Notice: Subject to any disclaimer, the term of this patent is extended or adjusted under 35 U.S.C. 154(b) by 0 days.

(21) Appl. No.: 10/219,943

(22) Filed: Aug. 16, 2002

(51) Int. Cl.[7] ..... B24B 1/00

(52) U.S. Cl. ..... 451/38; 451/92; 451/99; 451/354

(58) Field of Search ..... 451/38, 92, 99, 451/354

(56) References Cited

U.S. PATENT DOCUMENTS

| | | | | | |
|---|---|---|---|---|---|
| 3,589,081 | A | * | 6/1971 | Kilischenko | 451/38 |
| 3,864,876 | A | * | 2/1975 | Diehn | 451/92 |
| 3,911,849 | A | * | 10/1975 | Hammelmann | 114/222 |
| 3,916,568 | A | * | 11/1975 | Rose et al. | 451/92 |
| 4,545,156 | A | * | 10/1985 | Hockett | 451/2 |
| 4,546,574 | A | * | 10/1985 | Blossick et al. | 451/354 |
| 4,939,872 | A | * | 7/1990 | Revelin et al. | 451/354 |
| 5,001,870 | A | * | 3/1991 | Yokota et al. | 451/92 |
| 5,138,800 | A | * | 8/1992 | Janusz | 451/5 |
| 5,240,503 | A | * | 8/1993 | Levy et al. | 118/323 |
| 5,419,734 | A | * | 5/1995 | Van Sickle | 451/90 |
| 5,588,900 | A | * | 12/1996 | Urakami | 451/92 |
| 5,679,172 | A | * | 10/1997 | Pritt | 134/6 |
| 5,785,581 | A | * | 7/1998 | Settles | 451/99 |
| 5,947,796 | A | * | 9/1999 | Imayama et al. | 451/2 |
| 6,186,410 | B1 | | 2/2001 | Mercier et al. | |
| 6,464,569 | B1 | * | 10/2002 | Thierer | 451/92 |
| 6,565,420 | B2 | * | 5/2003 | Lisec | 451/38 |

OTHER PUBLICATIONS

The Fosbel Process, Ceramic Welding, The only durable hot repair method for glass furnaces; Fosbel Ceramic Technologies.

Preventative maintenance; The positive approach to ending intermediate repairs; Fosbel Ceramic Technologies.

Aluminum furnace repair without shutdown; Fosbel Ceramic Technologies.

Sprayed–on ceramic coatings increase furnace life and efficiency; Energy Management Technology, Mar. 1986, pp. 34–37.

Ceramic Welding; Refractory Renewal Without Shutdown; Fosbel Ceramic Technologies.

Ceramic Industry; The exclusive Global Voice of Ceramic Business & Manufacturing; Ceramic Welding: Performance by Design by Kevin Pendleton.

High emissivity coatings—their effects on efficiency improvement in olefin process heaters by Michael Ennis, Cetek Limited, New South Wales, Australia; Cetek Ceramic Technologies.

* cited by examiner

*Primary Examiner*—M. Rachuba
(74) *Attorney, Agent, or Firm*—Nixon & Vanderhye P.C.

(57) ABSTRACT

Apparatus and methods allow difficulty accessible sites of a structure to be sand-blasted. Preferred sand-blasting systems are provided which include a sand-blasting fixture to support the a sand-blasting nozzle and a distal portion of the supply hose in such a manner that the spray of grit particulates may be directed against the difficultly accessible site of the structure. The fixture most preferably includes rigid proximal and distal support tubes joined to one another so as to establish an angle therebetween (most preferably about 90°), and a rigid back-lash support member extending outwardly from the distal support tube. In such a manner, the distal portion of the supply hose is movably supported within the proximal and distal support tubes such that the nozzle positioned adjacent to the back-lash support member may be adjustable by means of the distal portion of the supply hose being further advanced into or retracted from within the proximal and distal support tubes. A clamp member is most preferably provided to positionally fix the nozzle to the back-lash support member.

20 Claims, 3 Drawing Sheets

SAND BLASTING APPARATUS AND METHODS

FIELD OF THE INVENTION

The present invention relates generally to sand blasting apparatus and methods which are especially well suited for directing a spray of relatively fine grit particulates (e.g., sand) toward surfaces that are difficult to access (e.g., pipe surfaces located immediately adjacent a process vessel wall).

BACKGROUND AND SUMMARY OF THE INVENTION

The technique of abrading a surface by directing a pressurized spray of grit particulates thereagainst is colloquially known as "sand blasting". Sand blasting is a notoriously well known technique for removing materials from rigid surfaces. Essentially, sand blasting effectively "cleans" undesired materials accumulated on a surface by means of the abrasive action caused by a high pressure stream of grit particulates directed against the surface. Thus, sand blasting is particularly effective for use against mortar or metal surfaces prior to application of coating materials.

There are a variety of sand blasting apparatus to accomplish a variety of surfaces. Oftentimes, however, conventional sand blasting apparatus cannot be employed effectively to abrade surfaces with relatively small clearance between the surface to be sand blasted and an adjacent rigid structure. For example, it is sometimes necessary to remove scale from pipes within process equipment, such as coker units employed in the manufacture of hydrocarbon products. One side of such pipes in conventional coker units (especially so-called "single fired" coker units), however, may be located physically close to the refractory wall of the vessel thereby making scale removal by means of sand blasting difficult, if not impossible.

It would therefore be highly desirable if apparatus and methods were available which would allow sand blasting of surfaces that are difficult to access. It is toward providing such apparatus and methods that the present invention is directed.

Broadly, the present invention is directed to apparatus and methods whereby difficulty accessible sites of a structure may be sand-blasted. More specifically, according to an aspect of the present invention, sand-blasting systems are provide which include a source of pressurized grit particulates, a nozzle for discharging a spray of the pressurized grit particulates, and a flexible supply hose connecting the source of the grit particulates to the nozzle so as to supply the grit particulates from the source thereof to the nozzle. Important to the present invention, a sand-blasting fixture supports the nozzle and a distal portion of the supply hose in such a manner that the spray of grit particulates may be directed against the difficultly accessible site of the structure.

In preferred forms, the fixture includes rigid proximal and distal support tubes joined to one another so as to establish an angle therebetween, and a rigid back-lash support member extending outwardly from the distal support tube. In such a manner, the distal portion of the supply hose is movably supported within the proximal and distal support tubes such that the nozzle positioned adjacent to the back-lash support member may be adjustable by means of the distal portion of the supply hose being further advanced into or retracted from within the proximal and distal support tubes. A clamp member is most preferably provided to positionally fix the nozzle to the back-lash support member.

These as well as other aspects and advantages of the present invention will become more clear after careful consideration is given to the following detailed description of the preferred exemplary embodiment thereof which follows.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
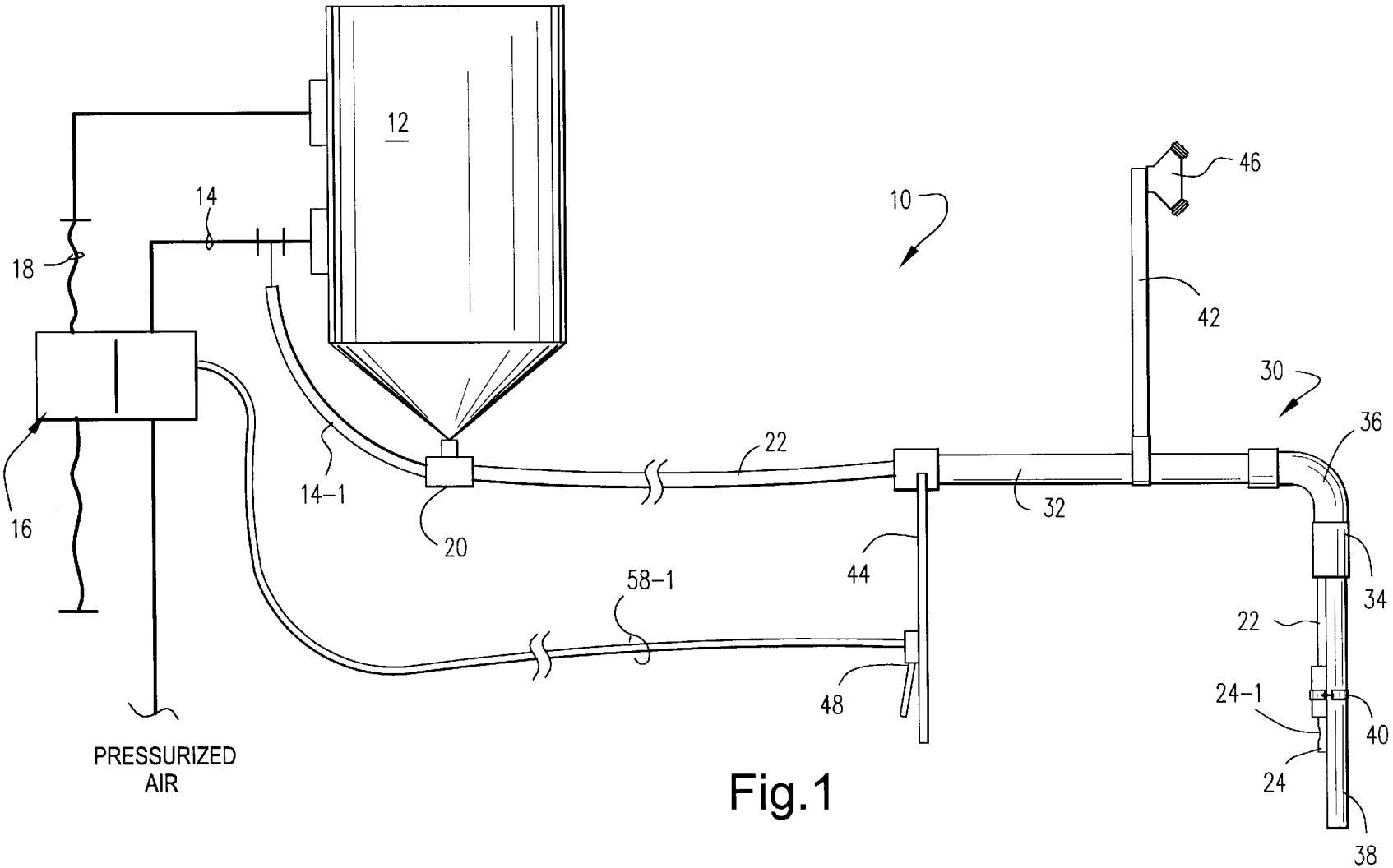
FIG. 1 is a schematic depiction of a representative embodiment of a sand blasting apparatus in accordance with the present invention.

An exemplary sand blasting system 10 in accordance with the present invention is depicted in accompanying FIG. 1. In this regard, the system 10 generally includes a vessel 12 which for containing a quantity of grit particulates to be employed in the sand blasting operation. As is conventional, the vessel 12 is pressurized with air supplied via line 14 through the normally closed ports of a pinch valve 16. A flexible and compressible depressurizing line 18 communicates between the normally open ports of the pinch valve 16.

The pressure line 14 is also connected via line 14-1 to a miser valve 20 at the discharged of the vessel 12. The miser valve is in turn connected to supply hose 22. The distal end portion 22-1 of the supply hose 22 terminates in a sand blasting nozzle 24. Thus, in use, the pressurized air passing through the miser valve 20 causes a controlled amount of grit particulates to be entrained in the air flow which is then transported to, and discharged as a spray from, the nozzle 24.

Figure 2:
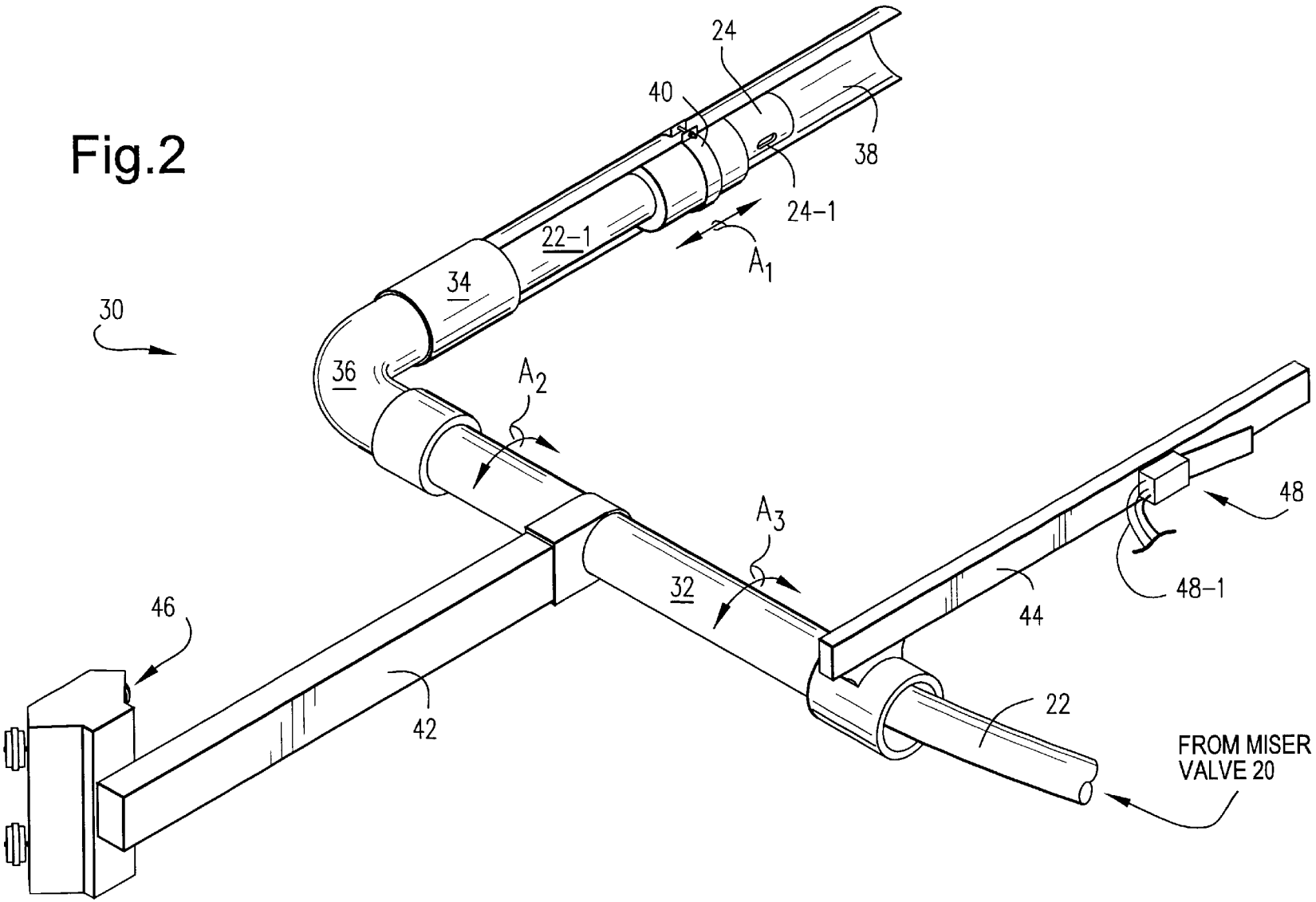
FIG. 2 is rear perspective view of a preferred sand blasting fixture in accordance with the present invention.

Important to the present invention is the fixture 30 which supports the distal end portion 22-1 of the flexible supply hose 22 and its associated nozzle 24. As is perhaps more clearly shown in accompanying FIG. 2, the fixture 30 is generally comprised of a rigid proximal support tube 32, and a contiguous rigid distal support tube 34. The distal support tube 34 is coupled rigidly to the proximal support tube 32 by means of a transition tube section 36 so that the distal support tube 34 is oriented angularly with respect to the proximal support tube 32. It will be appreciated that virtually any desired angular orientation of the distal support tube 34 relative to the proximal support tube 32 may be provided in dependence upon the individual transition tube 36 that is employed. Thus, it will be understood that the depiction of a generally right angle (90°) orientation between the proximal and distal support tubes 32, 34, respectively, represents a particularly preferred embodiment of the present invention which is exemplary only and thereby non-limiting.

As shown, the distal portion 22-1 of the supply hose is housed within the fixture 30 and extends sequentially through the proximal support tube 32, the transition tube section 36 and the distal support tube 34. A back-lash support member 38 extends outwardly from the terminal end of the distal support tube 34 so as to prevent reactive back-lash of the nozzle member 24 during sand blasting operations. Thus, since the distal portion 22-1 of the supply hose 22 is flexible, the support member 38 prevents reactive back-lash of the nozzle from occurring by virtue of the discharge of a pressurized stream of grit particles from the nozzle aperture 24-1.

As shown, the support member 38 most preferably establishes a concave surface for accommodating the distal portion 22-1 of the hose 22 and its associated nozzle member 24. The nozzle member 24 may be positionally fixed to the support member 38 by means of a clamp assembly 40. Most preferably, the clamp assembly 40 is of a type that is capable of being loosened to an extent or removed to allow the nozzle member 24 to be positionally adjusted along the lengthwise dimension of the support member 38 as depicted generally by arrow $A_1$ in FIG. 2. Thus, by loosening/removing the clamp assembly 40, a desired length of the supply hose 22 may be advanced into or withdrawn from the proximal support tube 32 thereby allowing the nozzle member 24 to be moved respectively away from or closer to the distal support tube 34.

Forward and rearward handle members 42, 44 are fixed to, and project laterally outwardly from, the proximal support tube 32. Most preferably, each of the handle member 42, 44 are adjustable coupled to the proximal support tube 32 so as to allow for rotation about the support tube's axis (as depicted by arrows $A_2$ and $A_3$, respectively in FIG. 2) thereby permitting selection of the relative positioning of the handles 42, 44 as may be desired by the individual operator.

The forward handle 42 may include a removable and support carriage 46 to assist the operator in supporting the fixture 30 against immovable structures during sand blasting operation. The support carriage 30 may also be adjustable along the lengthwise dimension of the handle 42 to allow it to be positioned relative to immovable structures against which it is to be placed. The rearward handle 44 most preferably carries a pneumatic switch 48 which is connected to the pinch valve 16 via pneumatic signal lines 48-1. By manually depressing the switch 48, the operator will cause the pinch valve 16 to operate so as to open its normally close ports and close its normally open ports. As such, the vessel 12 will become pressurized and will thereby cause the sand blasting operation to begin. Of course, when the operator releases the switch 48, the pinch valve 16 will revert to its normal conditions thereby depressurizing the vessel 12 and causing the sand blasting operation to cease.

Figure 3:
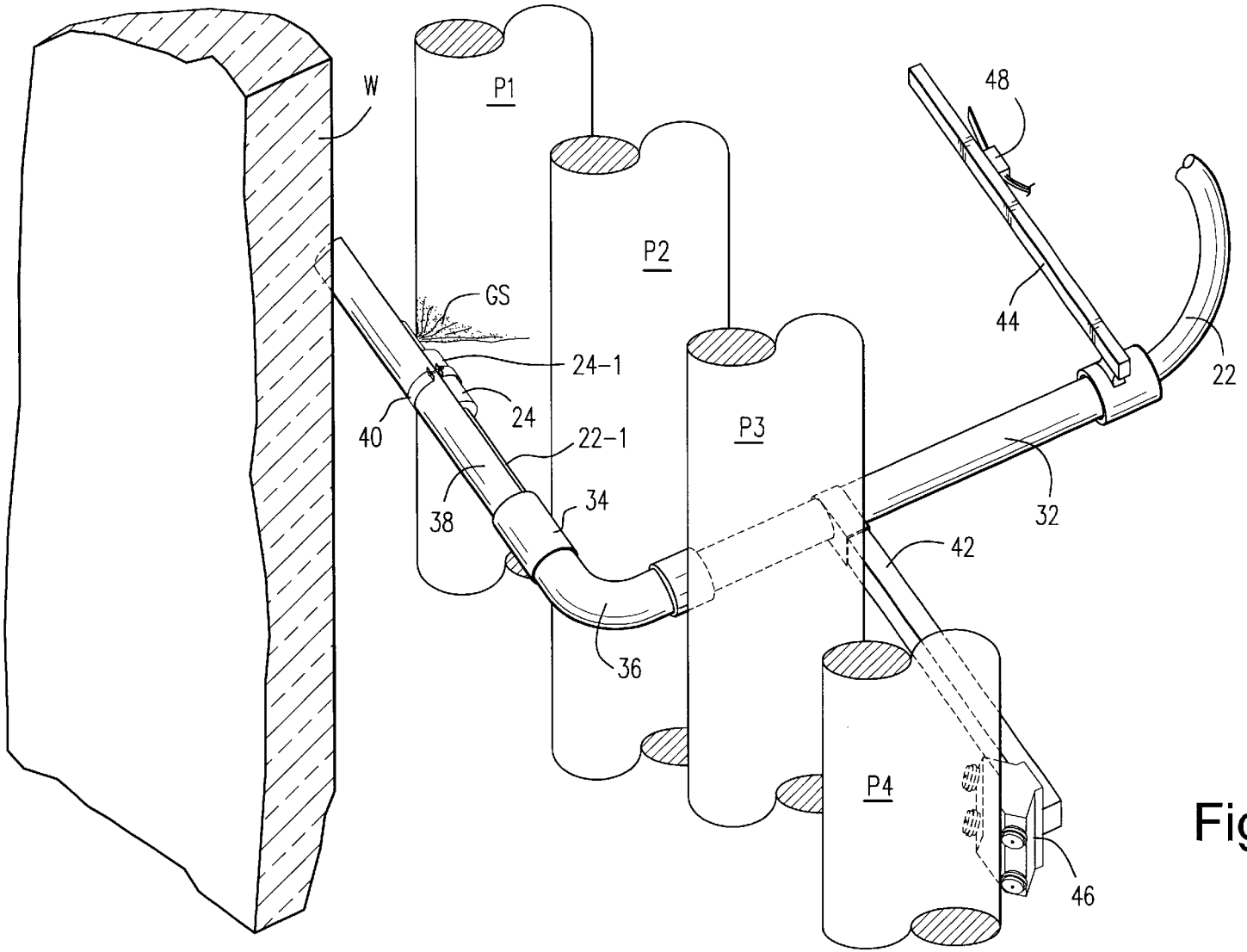
FIG. 3 is a perspective view of the sand blasting fixture depicted in FIG. 2 showing a manner in which structures may be sand blasted thereby.

Accompanying FIG. 3 depicts one possible use of the fixture 30 to sand blast difficultly accessible exterior surfaces of pipes P1–P4 located closely adjacent to a wall W within a process vessel (not shown). In this regard, pipes P1–P4 may be, for example, process pipes P1–P4 located within a coker unit used in the manufacture of hydrocarbon products. Such coker unit pipes P1–P4 thereby need to be de-scaled periodically. Descaling of the rear portion of the exterior surfaces of pipes P1–P4 located immediately adjacent the wall W may thus be facilitated by the fixture 30 in accordance with the present invention. That is, as shown in FIG. 3, the fixture 30 may be positioned relative to the pipes P1–P4 so that the distal support tube 34, and hence the nozzle member 24, are positioned in the space between the process vessel wall W and the rear surface portion of the pipes P1–P4. A stream of high pressure grit particulates (noted in FIG. 3 generally by GS) issuing from the nozzle aperture 24 is thereby able to be directed against the otherwise difficultly accessible rear external surfaces of the pipes P1–P4 thereby sand blasting the same.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sand-blasting system comprising:

a source of pressurized grit particulates;

a nozzle for discharging a spray of the pressurized grit particulates;

a flexible supply hose connecting the source of the grit particulates to the nozzle to supply the grit particulates from the source thereof to the nozzle; and a sand-blasting fixture for supporting the nozzle and a distal portion of the supply hose, wherein said fixture includes:

(i) rigid proximal and distal support tubes joined to one another so as to establish an angle therebetween;

(ii) rigid back-lash support member extending outwardly from said distal support tube; wherein (iii) said distal portion of the supply hose is movably supported within said proximal and distal support tubes such that said nozzle positioned adjacent to said back-lash support member is adjustable by means of said distal portion of the supply hose being further advanced into or retracted from said proximal and distal support tubes.

2. The sand-blasting system of claim 1, wherein said nozzle includes a nozzle aperture which directs the spray of grit particulates in a proximal direction.

3. The sand-blasting system of claim 2, wherein said back-lash support member is disposed on a distal side of said nozzle.

4. The sand-blasting system of claim 1, 2 or 3, wherein said fixture further includes a clamp for positionally fixing said nozzle to said back-lash support member.

5. The sand-blasting system of claim 1, wherein said fixture includes a handle member which extends generally radially outwardly from said proximal support tube.

6. The sand-blasting system of claim 1, wherein said fixture includes forward and rearward handle members each extending generally radially outwardly from said proximal support tube.

7. The sand-blasting system of claim 6, wherein said forward and rearward handle members extend outwardly in generally opposite directions relative to one another.

8. The sand-blasting system as in claim 5, wherein said handle member includes a carriage member to assist in supporting the fixture against a rigid structure.

9. The sand-blasting system as in claim 6, wherein said forward handle member includes a carriage member to assist in supporting the fixture against a rigid structure.

10. A sand-blasting system as in claim 1, wherein said proximal and distal support tubes are substantially at a right angle to one another.

11. A fixture for supporting a distal portion of a flexible supply hose and a nozzle attached at a terminal end of the supply hose, said fixture comprising:

(i) rigid proximal and distal support tubes joined to one another so as to establish an angle therebetween;

(ii) a rigid back-lash support member extending outwardly from said distal support tube; wherein (iii) said distal portion of the supply hose is movably supportable within said proximal and distal support tubes such that said nozzle may be positioned adjacent to said back-lash support member for adjustment by means of said distal portion of the supply hose being further advanced into or retracted from said proximal and distal support tubes.

12. The sand-blasting system of claim 11, wherein said back-lash support member is disposed on a distal side of said nozzle.

13. The fixture of claim 11 or 12, which further comprises a clamp for positionally fixing said nozzle to said back-lash support member.

14. The fixture of claim 12, wherein said fixture includes a handle member which extends generally radially outwardly from said proximal support tube.

15. The fixture of claim 12, wherein said fixture includes forward and rearward handle members each extending generally radially outwardly from said proximal support tube.

16. The fixture of claim 15, wherein said forward and rearward handle members extend outwardly in generally opposite directions relative to one another.

17. The fixture as in claim 14, wherein said handle member includes a carriage member to assist in supporting the fixture against a rigid structure.

18. The fixture as in claim 15, wherein said forward handle member includes a carriage member to assist in supporting the fixture against a rigid structure.

19. A fixture as in claim 11, wherein said proximal and distal support tubes are substantially at a right angle to one another.

20. A method of sand-blasting a difficultly accessible site of a structure comprising the steps of:

(a) providing a sand-blasting fixture having proximal and distal support tubes angularly oriented with respect to one another and a back-lash support member extending outwardly from said distal support tube;

(b) positioning a distal portion of a flexible sand-blasting supply hose within the fixture to allow a nozzle at a terminal end of the supply hose to be positioned adjacent the back-lash support member such that an aperture of the nozzle is capable of directing a spray of grit particulates generally proximally;

(c) positioning the fixture such that the spray of grit particulates from the nozzle aperture is directed against the difficultly accessible site of the structure; and (d) supply a pressurized quantity of grit particulates through the supply hose to the nozzle so as to be discharged as a spray from the nozzle aperture in a generally proximal direction so as to sand-blast the difficulty accessible site of the structure.

* * * * *